US007805313B2

(12) United States Patent
Faller et al.

(10) Patent No.: US 7,805,313 B2
(45) Date of Patent: Sep. 28, 2010

(54) FREQUENCY-BASED CODING OF CHANNELS IN PARAMETRIC MULTI-CHANNEL CODING SYSTEMS

(75) Inventors: Christof Faller, Tägerwilen (CH); Juergen Herre, Buckenhof (DE)

(73) Assignee: Agere Systems Inc., Allentown, PA (US)

( * ) Notice: Subject to any disclaimer, the term of this patent is extended or adjusted under 35 U.S.C. 154(b) by 1043 days.

(21) Appl. No.: 10/827,900

(22) Filed: Apr. 20, 2004

(65) Prior Publication Data

US 2005/0195981 A1 Sep. 8, 2005

Related U.S. Application Data

(60) Provisional application No. 60/549,972, filed on Mar. 4, 2004.

(51) Int. Cl.
*G10L 19/00* (2006.01)
*H04R 5/00* (2006.01)

(52) U.S. Cl. ..... 704/500; 381/23

(58) Field of Classification Search ..... 381/22–23, 381/106, 98, 94.2, 94.3, 77, 79; 704/500–504
See application file for complete search history.

(56) References Cited

U.S. PATENT DOCUMENTS

| | | | | |
|---|---|---|---|---|
| 4,236,039 A | | 11/1980 | Cooper | 381/23 |
| 4,815,132 A | | 3/1989 | Minami | 381/1 |
| 4,972,484 A | | 11/1990 | Theile et al. | 704/200.1 |
| 5,371,799 A | | 12/1994 | Lowe et al. | 381/25 |
| 5,463,424 A | * | 10/1995 | Dressler | 348/485 |
| 5,579,430 A | | 11/1996 | Grill et al. | 395/2.12 |
| 5,583,962 A | | 12/1996 | Davis et al. | 395/2.38 |
| 5,677,994 A | * | 10/1997 | Miyamori et al. | 704/501 |
| 5,682,461 A | | 10/1997 | Silzle et al. | 395/2.14 |
| 5,701,346 A | | 12/1997 | Herre et al. | 381/18 |

(Continued)

FOREIGN PATENT DOCUMENTS

CN 1295778 5/2001

(Continued)

OTHER PUBLICATIONS

C. Faller,"Binaural Cue Coding: Rendering of sources mixed into a mono signal,"□□ in Proc. DAGA 2003, Aachen, Germany, Mar. 2003 (invited).*

(Continued)

*Primary Examiner*—Vivian Chin
*Assistant Examiner*—Kile Blair
(74) *Attorney, Agent, or Firm*—Mendelsohn, Drucker & Associates, P.C.; Steve Mendelsohn

(57) ABSTRACT

For a multi-channel audio signal, parametric coding is applied to different subsets of audio input channels for different frequency regions. For example, for a 5.1 surround sound signal having five regular channels and one low-frequency (LFE) channel, binaural cue coding (BCC) can be applied to all six audio channels for sub-bands at or below a specified cut-off frequency, but to only five audio channels (excluding the LFE channel) for sub-bands above the cut-off frequency. Such frequency-based coding of channels can reduce the encoding and decoding processing loads and/or size of the encoded audio bitstream relative to parametric coding techniques that are applied to all input channels over the entire frequency range.

26 Claims, 2 Drawing Sheets

U.S. PATENT DOCUMENTS

| | | | | |
|---|---|---|---|---|
| 5,703,999 | A | 12/1997 | Herre et al. | 395/2.12 |
| 5,706,309 | A | 1/1998 | Eberlein et al. | 375/260 |
| 5,771,295 | A | 6/1998 | Waller, Jr. | 381/18 |
| 5,812,971 | A | 9/1998 | Herre | 704/230 |
| 5,825,776 | A | 10/1998 | Moon | 370/437 |
| 5,860,060 | A | 1/1999 | Li et al. | 704/500 |
| 5,878,080 | A | 3/1999 | Ten Kate | 375/241 |
| 5,889,843 | A | 3/1999 | Singer et al. | 379/202.01 |
| 5,890,125 | A | 3/1999 | Davis et al. | 704/501 |
| 5,912,976 | A | 6/1999 | Klayman et al. | 381/18 |
| 5,930,733 | A | 7/1999 | Park et al. | 702/76 |
| 5,946,352 | A | 8/1999 | Rowlands et al. | 375/242 |
| 5,956,674 | A | 9/1999 | Smyth et al. | 704/200.1 |
| 6,016,473 | A | 1/2000 | Dolby | 704/500 |
| 6,021,386 | A | 2/2000 | Davis et al. | 704/229 |
| 6,021,389 | A | 2/2000 | Protopapas | 704/278 |
| 6,108,584 | A * | 8/2000 | Edwards | 700/94 |
| 6,111,958 | A | 8/2000 | Maher | 381/17 |
| 6,131,084 | A | 10/2000 | Hardwick | 704/230 |
| 6,205,430 | B1 | 3/2001 | Hui | 704/500 |
| 6,236,731 | B1 | 5/2001 | Brennan et al. | 381/316 |
| 6,282,631 | B1 | 8/2001 | Arbel | 712/35 |
| 6,356,870 | B1 | 3/2002 | Hui et al. | 704/500 |
| 6,408,327 | B1 | 6/2002 | McClennon et al. | 709/204 |
| 6,424,939 | B1 | 7/2002 | Herre et al. | 704/219 |
| 6,434,191 | B1 | 8/2002 | Agrawal et al. | 375/227 |
| 6,539,357 | B1 | 3/2003 | Sinha | 704/270.1 |
| 6,614,936 | B1 | 9/2003 | Wu et al. | 382/238 |
| 6,658,117 | B2 | 12/2003 | Hasebe | 381/61 |
| 6,763,115 | B1 | 7/2004 | Kobayashi | 381/309 |
| 6,782,366 | B1 | 8/2004 | Huang et al. | 704/500 |
| 6,823,018 | B1 | 11/2004 | Jafarkhani et al. | 375/245 |
| 6,845,163 | B1 | 1/2005 | Johnston et al. | 381/92 |
| 6,850,496 | B1 | 2/2005 | Knappe et al. | 370/260 |
| 6,885,992 | B2 | 4/2005 | Mesarovic et al. | |
| 6,934,676 | B2 | 8/2005 | Wang et al. | 704/200.1 |
| 6,940,540 | B2 | 9/2005 | Beal et al. | 348/169 |
| 6,973,184 | B1 | 12/2005 | Shaffer et al. | 379/420.01 |
| 6,987,856 | B1 | 1/2006 | Feng et al. | |
| 7,116,787 | B2 | 10/2006 | Faller | 381/17 |
| 7,181,019 | B2 | 2/2007 | Breebart et al. | |
| 7,382,886 | B2 | 6/2008 | Henn et al. | 381/23 |
| 7,516,066 | B2 | 4/2009 | Schuijers et al. | 704/219 |
| 2001/0031054 | A1 | 10/2001 | Grimani | 381/98 |
| 2001/0031055 | A1 * | 10/2001 | Aarts et al. | 381/98 |
| 2002/0055796 | A1 * | 5/2002 | Katayama et al. | 700/94 |
| 2003/0035553 | A1 * | 2/2003 | Baumgarte et al. | 381/94.2 |
| 2003/0081115 | A1 | 5/2003 | Curry et al. | 348/14.12 |
| 2003/0161479 | A1 * | 8/2003 | Yang et al. | 381/22 |
| 2003/0187663 | A1 | 10/2003 | Truman et al. | 704/500 |
| 2003/0219130 | A1 * | 11/2003 | Baumgarte et al. | 381/17 |
| 2003/0236583 | A1 | 12/2003 | Baumgarte et al. | 700/94 |
| 2004/0091118 | A1 | 5/2004 | Griesinger | 381/20 |
| 2005/0053242 | A1 | 3/2005 | Henn et al. | 381/22 |
| 2005/0069143 | A1 | 3/2005 | Budnikov et al. | 381/63 |
| 2005/0157883 | A1 | 7/2005 | Herre et al. | 381/17 |
| 2005/0226426 | A1 * | 10/2005 | Oomen et al. | 381/23 |
| 2006/0206323 | A1 | 9/2006 | Breebaart | 704/230 |
| 2007/0094012 | A1 | 4/2007 | Pang et al. | |

FOREIGN PATENT DOCUMENTS

| | | | |
|---|---|---|---|
| EP | 1 107 232 | A2 | 6/2001 |
| EP | 1 376 538 | A1 | 1/2004 |
| EP | 1 479 071 | B1 | 1/2006 |
| JP | 07123008 | | 5/1995 |
| JP | H10-051313 | | 2/1998 |
| JP | 2004-535145 | A | 11/2004 |
| RU | 2214048 | C2 | 10/2003 |
| TW | 347623 | | 12/1998 |
| TW | 360859 | | 6/1999 |
| TW | 444511 | | 7/2001 |
| TW | 510144 | | 11/2002 |
| TW | 517223 | | 1/2003 |
| TW | 521261 | | 2/2003 |
| WO | WO 03/007656 | A1 | 1/2003 |
| WO | WO 03/090207 | A1 | 10/2003 |
| WO | WO 03/090208 | A1 | 10/2003 |
| WO | WO 03/094369 | A2 | 11/2003 |
| WO | WO 2004/008806 | A1 | 1/2004 |
| WO | WO 2004/049309 | A1 | 6/2004 |
| WO | WO 2004/072956 | A1 | 8/2004 |
| WO | WO 2004/077884 | A1 | 9/2004 |
| WO | WO 2004/086817 | A2 | 10/2004 |
| WO | WO 2005/069274 | A1 | 7/2005 |

OTHER PUBLICATIONS

Joseph Hull: "Surround Sound Past, Present, and Future", Dolby Laboratories, 1999, pp. 1-7.*

"Binaural Cue Coding—Part I: Psychoacoustic Fundamentals and Design Principles", by Frank Baumgrate et al., IEEE Transactions on Speech and Audio Processing, vol. II, No. 6, Nov. 2003, pp. 509-519.

"Binaural Cue Coding—Part II: Schemes and Applications", by Christof Faller et al., IEEE Transactions of Speech and Audio Processing, vol. II, NO. 6, Nov. 2003, pp. 520-531.

"Binaural Cue Coding Applied to Stereo and Multi-Channel Audio Compression", by Christof Faller et al., Audio Engineering Society Convention Paper, 112$^{th}$ Convention, Munich, Germany, May 10-13, 2002, pp. 1-9.

"Advances in Parametric Coding for High-Quality Audio", by Erik Schuijers et al., Audio Engineerying Society Convention Paper 5852, 114$^{th}$ Convention, Amsterdam, The Netherlands, Mar. 22-25, 2003, pp. 1-11.

"Colorless Artificial Reverberation", by M.R. Schroeder et al., IRE Transactions on Audio, pp. 209-214, (Originally Published by: J. Audio Engrg. Soc., vol. 9, pp. 192-197, Jul. 1961).

"Efficient Representation of Spatial Audio Using Perceptual Parametrization",, by Christof Faller etl al., IEEE Workshop on Applications of Signal Processing to Audio and Acoustics 2001, Oct. 21-24, 2001, New Paltz, New York, pp. W2001-01 to W2001-4.

"3D Audio and Acoustic Environment Modeling" by William G. Gardner, HeadWize Technical Paper, Jan. 2001, pp. 1-11.

"Responding to One of Two Simultaneous Message", by Walter Spieth et al., The Journal of the Acoustical Society of America, vol. 26, No. 3, May 1954, pp. 391-396.

"A Speech Corpus for Multitalker Communications Research", by Robert S. Bolia, et al., J. Acoust. Soc., Am., vol. 107, No. 2, Feb. 2000, pp. 1065-1066.

"Synthesized Stereo Combined with Acoustic Echo Cancellation for Desktop Conferencing", by Jacob Benesty et al., Bell Labs Technical Journal, Jul.-Sep. 1998, pp. 148-158.

"The Role of Perceived Spatial Separation in the Unmasking of Speech", by Richard Freyman et al., J. Acoust. Soc., Am., vol. 106, No. 6, Dec. 1999, pp. 3578-3588.

"Text of ISO/IEC 14496-3:2002/PDAM 2 (Parametric coding for High Quality Audio)", by International Organisation for Standisation ISO/IEC JTC1/SC29/WG11 Coding of Moving Pictures and Audio, MPEG2002 N5381 Awaji Island, Dec. 2002, pp. 1-69.

"*Final text for DIS 11172-1 (rev. 2): Information Technology-Coding of Moving Pictures and Associated Audio for Digital Storage Media—Part 1*," ISO/IEC JTC 1/SC 29 N 147, Apr. 20, 1992 Section 3: Audio, XP-002083108, 2 pages.

"Advances in Parametric Coding for High-Quality Audio," by E.G.P. Schuijers et al., Proc. 1$^{st}$ IEEE Benelux Workshop on Model Based Processing and Coding of Audio (MPCA-2002), Leuven, Belgium, Nov. 15, 2002, pp. 73-79, XP001156065.

"Improving Audio Codecs by Noise Substitution," by Donald Schulz, Journal of the Audio Engineering Society, vol. 44, No. 7/8, Jul./Aug. 1996, pp. 593-598, XP000733647.

"The Reference Model Architecture for MPEG Spatial Audio Coding," by Juergen Herre et al., Audio Engineering Society Convention Paper 6447, 118$^{th}$ Convention, May 28-31, 2005, Barcelona, Spain, pp. 1-13, XP009059973.

"From Joint Stereo to Spatial Audio Coding—Recent Progress and Standardization," by Jurgen Herre, Proc. of the 7th Int. Conference on Digital Audio Effects (DAFx'04), Oct. 5-8, 2004, Naples, Italy, XP002367849.

"Parametric Coding of Spatial Audio," by Christof Faller, Proc. of the 7th Int. Conference on Digital Audio Effects (DAFx'04), Oct. 5-8, 2004, Naples, Itlay, XP002367850.

"Binaural Cue Coding Applied to Stereo and Multi-Channel Audio Compression," by Christof Faller et al., Audio Engineering Society 112th Covention, Munich, Germany, vol. 112, No. 5574, May 10, 2002, pp. 1-9.

"MPEG Audio Layer II: A Generic Coding Standard For Two And Multichannel Sound For DVB, DAB and Computer Multimedia," by G. Stoll, International Broadcasting Convention, Sep. 14-18, 1995, Germany, XP006528918, pp. 136-144.

"MP3 Surround: Efficient and Compatible Coding of Multi-Channel Audio", by Juergen Herre et al., Audio Engineering Society 116th Convention Paper, May 8-11, 2004, Berlin, Germany, pp. 1-14.

"HILN- The MPEG-4 Parametric Audio Coding Tools" by Heiko Purnhagen and Nikolaus Meine, University of Hannover, Hannover, Germany, 4 pages.

"Parametric Audio Coding" by Bernd Edler and Heiko Purnhagen, University of Hannover, Hannover, Germany, pp. 1-4.

"Advances in Parametric Audio Coding" by Heiko Purnhagen, Proc. 1999 IEEE Workshop on Applications of Signal Processing to Audio and Acoustics, New Paltz, New York, Oct. 17-20, 1999, pp. W99-1-W99-4.

"Multichannel Natural Music Recording Based on Psychoacoustic Principles", by Gunther Theile, Extended version of the paper presented at the AES 19th International Conference, May 2001, Oct. 2001, pp. 1-45.

Office Action for Japanese Patent Application No. 2007-537133 dated Feb. 16, 2010 received on Mar. 10, 2010.

Christof Faller, "Parametric Coding of Spatial Audio, These No. 3062," Presentee A La Faculte Informatique et Communications, Institut de Systemes de Communication, Ecole Polytechnique Federale de Lausanne, Lausanne, EPFL 2004.

* cited by examiner

FREQUENCY-BASED CODING OF CHANNELS IN PARAMETRIC MULTI-CHANNEL CODING SYSTEMS

CROSS-REFERENCE TO RELATED APPLICATIONS

This application claims the benefit of the filing date of U.S. provisional application No. 60/549,972, filed on Mar. 4, 2004. The subject matter of this application is related to the subject matter of U.S. patent application Ser. No. 09/848,877, filed on May 4, 2001 ("the '877 application"), U.S. patent application Ser. No. 10/045,458, filed on Nov. 7, 2001 ("the '458 application"), and U.S. patent application Ser. No. 10/155,437, filed on May 24, 2002 ("the '437 application"), and U.S. patent application Ser. No. 10/815,591, filed on Apr. 1, 2004 ("the '591 application), the teachings of all four of which are incorporated herein by reference.

BACKGROUND OF THE INVENTION

1. Field of the Invention

The present invention relates to the encoding of audio signals and the subsequent synthesis of auditory scenes from the encoded audio data.

2. Description of the Related Art

Multi-channel surround audio systems have been standard in movie theaters for years. As technology has advanced, it has become affordable to produce multi-channel surround systems for home use. Today, such systems are mostly sold as "home theater systems." Conforming to an ITU-R recommendation, the vast majority of these systems provide five regular audio channels and one low-frequency sub-woofer channel (denoted the low-frequency effects or LFE channel). Such multi-channel system is denoted a 5.1 surround system. There are other surround systems, such as 7.1 (seven regular channels and one LFE channel) and 10.2 (ten regular channels and two LFE channels).

C. Faller and F. Baumgarte, "Efficient representation of spatial audio coding using perceptual parameterization," *IEEE Workshop on Appl. of Sig. Proc. to Audio and Acoust.*, October 2001, and C. Faller and F. Baumgarte, "Binaural Cue Coding Applied to Stereo and Multi-Channel Audio Compression," *Preprint* 112*th Conv. Aud. Eng. Soc.*, May 2002, (collectively, "the BCC papers") the teachings of both of which are incorporated herein by reference, describe a parametric multi-channel audio coding technique (referred to as BCC coding).

FIG. 1 shows a block diagram of an audio processing system 100 that performs binaural cue coding (BCC) according to the BCC papers. BCC system 100 has a BCC encoder 102 that receives C audio input channels 108, for example, one from each of C different microphones 106. BCC encoder 102 has a downmixer 110, which converts the C audio input channels into a mono audio sum signal 112.

In addition, BCC encoder 102 has a BCC analyzer 114, which generates BCC cue code data stream 116 for the C input channels. The BCC cue codes (also referred to as auditory scene parameters) include inter-channel level difference (ICLD) and inter-channel time difference (ICTD) data for each input channel. BCC analyzer 114 performs band-based processing to generate ICLD and ICTD data for each of one or more different frequency sub-bands (e.g., different critical bands) of the audio input channels.

BCC encoder 102 transmits sum signal 112 and the BCC cue code data stream 116 (e.g., as either in-band or out-of-band side information with respect to the sum signal) to a BCC decoder 104 of BCC system 100. BCC decoder 104 has a side-information processor 118, which processes data stream 116 to recover the BCC cue codes 120 (e.g., ICLD and ICTD data). BCC decoder 104 also has a BCC synthesizer 122, which uses the recovered BCC cue codes 120 to synthesize C audio output channels 124 from sum signal 112 for rendering by C loudspeakers 126, respectively.

Audio processing system 100 can be implemented in the context of multi-channel audio signals, such as 5.1 surround sound. In particular, downmixer 110 of BCC encoder 102 would convert the six input channels of conventional 5.1 surround sound (i.e., five regular channels+one LFE channel) into sum signal 112. In addition, BCC analyzer 114 of encoder 102 would transform the six input channels into the frequency domain to generate the corresponding BCC cue codes 116. Analogously, side-information processor 118 of BCC decoder 104 would recover the BCC cue codes 120 from the received side information stream 116, and BCC synthesizer 122 of decoder 104 would (1) transform the received sum signal 112 into the frequency domain, (2) apply the recovered BCC cue codes 120 to the sum signal in the frequency domain to generate six frequency-domain signals, and (3) transform those frequency-domain signals into six time-domain channels of synthesized 5.1 surround sound (i.e., five synthesized regular channels+one synthesized LFE channel) for rendering by loudspeakers 126.

SUMMARY OF THE INVENTION

For surround sound applications, embodiments of the present invention involve a BCC-based parametric audio coding technique in which band-based BCC coding is not applied to low-frequency sub-woofer (LFE) channel(s) for frequency sub-bands above a cut-off frequency. For example, for 5.1 surround sound, BCC coding is applied to all six channels (i.e., the five regular channels plus the one LFE channel) for sub-bands below the cut-off frequency, while BCC coding is applied to only the five regular channels (i.e., and not to the LFE channel) for sub-bands above the cut-off frequency. By avoiding BCC coding of the LFE channel at "high" frequencies, these embodiments of the present invention have (1) reduced processing loads at both the encoder and decoder and (2) smaller BCC code bitstreams than corresponding BCC-based systems that process all six channels at all frequencies.

More generally, the present invention involves the application of parametric audio coding techniques, such as BCC coding, but not necessarily limited to BCC coding, where two or more different subsets of input channels are processed for two or more different frequency ranges. As used in this specification, the term "subset" may refer to the set containing all of the input channels as well as to those proper subsets that include fewer than all of the input channels. The application of the present invention to BCC coding of 5.1 and other surround sound signals is just one particular example of the present invention.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Figure 1:
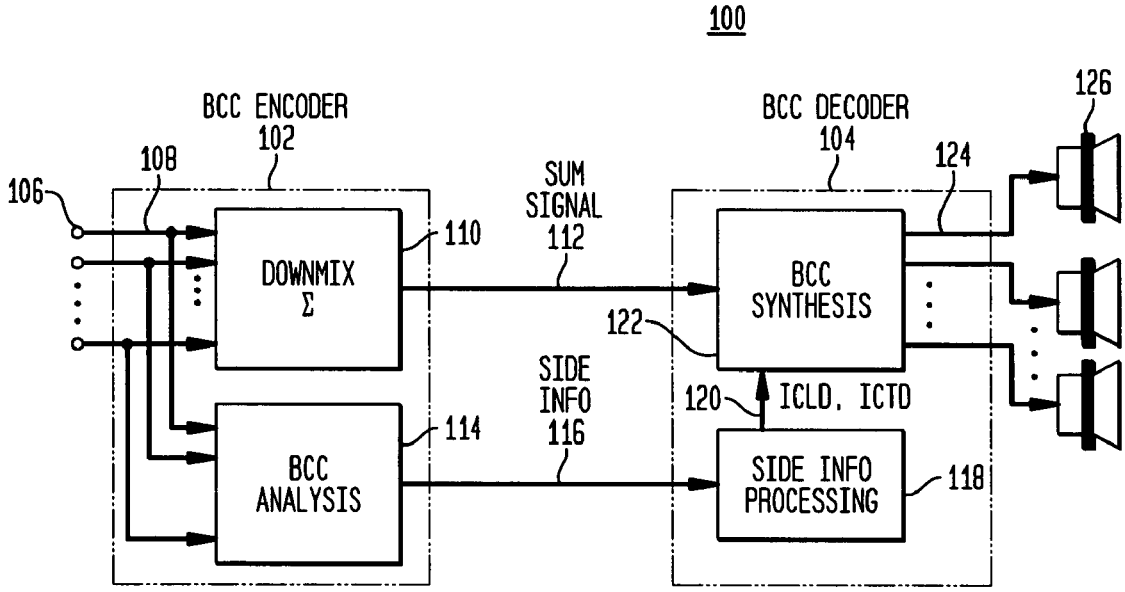
FIG. 1 shows a block diagram of an audio processing system that performs binaural cue coding (BCC)
Figure 2:
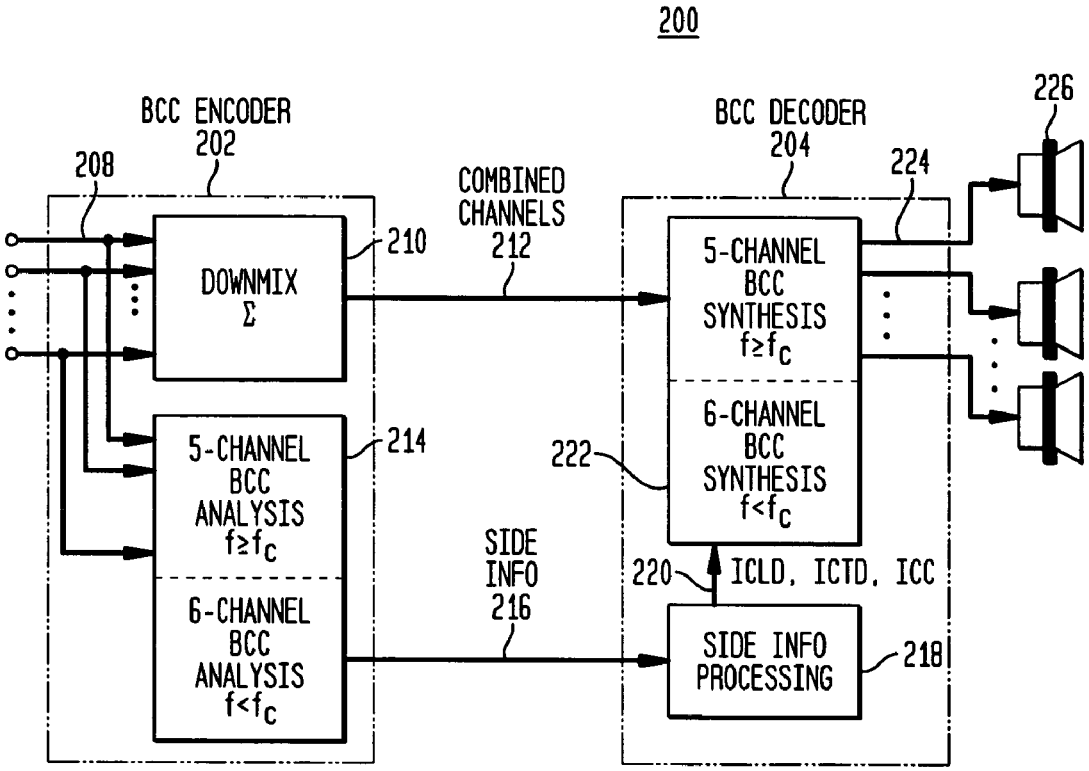
FIG. 2 shows a block diagram of an audio processing system that performs BCC coding according to one embodiment of the present invention.

FIG. 2 shows a block diagram of an audio processing system 200 that performs binaural cue coding (BCC) for 5.1 surround audio, according to one embodiment of the present invention. BCC system 200 has a BCC encoder 202, which receives six audio input channels 208 (i.e., five regular channels and one LFE channel). BCC encoder 202 has a downmixer 210, which converts (e.g., averages) the audio input channels (including the LFE channel) into one or more, but fewer than six, combined channels 212.

In addition, BCC encoder 202 has a BCC analyzer 214, which generates BCC cue code data stream 216 for the input channels. As indicated in FIG. 2, for frequency sub-bands at or below a specified cut-off frequency $f_c$, BCC analyzer 214 uses all six 5.1 surround sound input channels (including the LFE channel) when generating the BCC cue code data. For all other (i.e., high-frequency) sub-bands, BCC analyzer 214 uses only the five regular channels (and not the LFE channel) to generate the BCC cue code data. As a result, the LFE channel contributes BCC codes for only BCC sub-bands at or below the cut-off-frequency rather than for the full BCC frequency range, thereby reducing the overall size of the side-information bitstream.

The cut-off frequency is preferably chosen such that the effective audio bandwidth of the LFE channel is smaller than or equal to $f_c$ (that is, the LFE channel has substantially zero energy or insubstantial audio content beyond the cut-off frequency). Unless the frequency sub-bands are aligned with the cut-off frequency, the cut-off frequency falls within a particular frequency sub-band. In that case, part of that sub-band will exceeds the cut-off frequency. For purposes of this specification, such a sub-band is referred to as being "at" the cut-off frequency. In preferred embodiments, that entire sub-band of the LFE channel is BCC coded, and the next higher frequency sub-band is the first high-frequency sub-band that is not BCC coded.

In one possible implementation, the BCC cue codes include inter-channel level difference (ICLD), inter-channel time difference (ICTD), and inter-channel correlation (ICC) data for the input channels. BCC analyzer 214 preferably performs band-based processing analogous to that described in the '877 and '458 applications to generate ICLD and ICTD data for different frequency sub-bands of the audio input channels. In addition, BCC analyzer 214 preferably generates coherence measures as the ICC data for the different frequency sub-bands. These coherence measures are described in greater detail in the '437 and '591 applications.

BCC encoder 202 transmits the one or more combined channels 212 and the BCC cue code data stream 216 (e.g., as either in-band or out-of-band side information with respect to the combined channels) to a BCC decoder 204 of BCC system 200. BCC decoder 204 has a side-information processor 218, which processes data stream 216 to recover the BCC cue codes 220 (e.g., ICLD, ICTD, and ICC data). BCC decoder 204 also has a BCC synthesizer 222, which uses the recovered BCC cue codes 220 to synthesize six audio output channels 224 from the one or more combined channels 212 for rendering by six surround-sound loudspeakers 226, respectively.

As indicated in FIG. 2, BCC synthesizer 222 performs six-channel BCC synthesis for sub-bands at or below the cut-off frequency $f_c$, to generate frequency content for all six 5.1 surround channels (i.e., including the LFE channel), while performing five-channel BCC synthesis for sub-bands above the cut-off frequency to generate frequency content for only the five regular channels of 5.1 surround sound. In particular, BCC synthesizer 222 decomposes the received combined channel(s) 212 into a number of frequency sub-bands (e.g., critical bands). In these sub-bands, different processing is applied to obtain the corresponding sub-bands of the output audio channels. The result is that, for the LFE channel, only sub-bands with frequencies at or below the cut-off frequency are obtained. In other words, the LFE channel has frequency content only for sub-bands at or below the cut-off frequency. The upper sub-bands of the LFE channel (i.e., those above the cut-off frequency) may be filled with zero signals (if necessary).

Depending on the particular implementation, a BCC encoder could be designed to generate BCC cue codes for all frequencies and simply not transmit those codes for particular sub-bands (e.g., sub-bands above the cut-off frequency and/or sub-bands having substantially zero energy). Similarly, the corresponding BCC decoder could designed to perform conventional BCC synthesis for all frequencies, where the BCC decoder applies appropriate BCC cue code values for those sub-bands having no explicitly transmitted codes.

Although the present invention has been described in the context of BCC decoders that apply the techniques of the '877 and '458 applications to synthesize auditory scenes, the present invention can also be implemented in the context of BCC decoders that apply other techniques for synthesizing auditory scenes that do not necessarily rely on the techniques of the '877 and '458 applications. For example, the BCC processing of the present invention can be implemented without ICTD, ICLD, and/or ICC data, with or without other suitable cue codes, such as, for example, those associated with head-related transfer functions.

In the embodiment of FIG. 2, 5.1 surround sound is encoded by applying six-channel BCC analysis to sub-bands at or below the cut-off frequency and five-channel BCC analysis to sub-bands above the cut-off frequency. In another embodiment, the present invention can be applied to 7.1 surround sound in which eight-channel BCC analysis is applied to sub-bands at or below a specified cut-off frequency and seven-channel BCC analysis (excluding the single LFE channel) is applied to sub-bands above the cut-off frequency.

The present invention can also be applied to surround audio having more than one LFE channel. For example, for 10.2 surround sound, twelve-channel BCC analysis could be applied to sub-bands at or below a specified cut-off frequency, while ten-channel BCC analysis (excluding the two LFE channels) could be applied to sub-bands above the cut-off frequency. Alternatively, there could be two different cut-off frequencies specified: a first cut-off frequency for a first LFE channel of the 10.2 surround sound and second cut-off frequency for the second LFE channel. In this case and assuming that the first cut-off frequency is lower than the second cut-off frequency, twelve-channel BCC analysis could be applied to sub-bands at or below the first cut-off frequency, eleven-channel BCC analysis (excluding the first LFE channel) could be applied to sub-bands that are (1) above the first cut-off frequency and (2) at or below the second cut-off frequency, and ten-channel BCC analysis (excluding both LFE channels) could be applied to sub-bands above the second cut-off frequency.

Similarly, some consumer multi-channel equipment is purposely designed with different output channels having different frequency ranges. For example, some 5.1 surround sound equipment have two rear channels that are designed to reproduce only frequencies below 7 kHz. The present invention could be applied to such systems by specifying two cut-off frequencies: one for the LFE channel and a higher one for the rear channels. In this case, six-channel BCC analysis could be applied to sub-bands at or below the LFE cut-off frequency, five-channel BCC analysis (excluding the LFE channel) could be applied to sub-bands that are (1) above the LFE cut-off frequency and (2) at or below the rear-channel cut-off frequency, and three-channel BCC analysis (excluding the LFE channel and the two rear channels) could be applied to sub-bands above the rear-channel cut-off frequency.

The present invention can be generalized further to apply parametric audio coding to two or more different subsets of input channels for two or more different frequency regions, where the parametric audio coding could be other than BCC coding and the different frequency regions are chosen such that the frequency content of the different input channels is reflected in these regions. Depending on the particular application, different channels could be excluded from different frequency regions in any suitable combinations. For example, low-frequency channels could be excluded from high-frequency regions and/or high-frequency channels could be excluded from low-frequency regions. It may even be the case that no single frequency region involves all of the input channels.

As described previously, although the input channels 208 can be downmixed to form a single combined (e.g., mono) channel 212, in alternative implementations, the multiple input channels can be downmixed to form two or more different "combined" channels, depending on the particular audio processing application. More information on such techniques can be found in U.S. patent application Ser. No. 10/762,100, filed on Jan. 20, 2004, the teachings of which are incorporated herein by reference.

In some implementations, when downmixing generates multiple combined channels, the combined channel data can be transmitted using conventional audio transmission techniques. For example, when two combined channels are generated, conventional stereo transmission techniques may be able to be employed. In this case, a BCC decoder can extract and use the BCC codes to synthesize a multi-channel signal (e.g., 5.1 surround sound) from the two combined channels. Moreover, this can provide backwards compatibility, where the two BCC combined channels are played back using conventional (i.e., non-BCC-based) stereo decoders that ignore the BCC codes. Analogously, backwards compatibility can be achieved for a conventional mono decoder when a single BCC combined channel is generated. Note that, in theory, when there are multiple "combined" channels, one or more of the combined channels may actually be based on individual input channels.

Although BCC system 200 can have the same number of audio input channels as audio output channels, in alternative embodiments, the number of input channels could be either greater than or less than the number of output channels, depending on the particular application. For example, the input audio could correspond to 7.1 surround sound and the synthesized output audio could correspond to 5.1 surround sound, or vice versa.

In general, BCC encoders of the present invention may be implemented in the context of converting M input audio channels into N combined audio channels and one or more corresponding sets of BCC codes, where $M>N\geqq 1$. Similarly, BCC decoders of the present invention may be implemented in the context of generating P output audio channels from the N combined audio channels and the corresponding sets of BCC codes, where $P>N$, and P may be the same as or different from M.

Depending on the particular implementation, the various signals received and generated by both BCC encoder 202 and BCC decoder 204 of FIG. 2 may be any suitable combination of analog and/or digital signals, including all analog or all digital. Although not shown in FIG. 2, those skilled in the art will appreciate that the one or more combined channels 212 and the BCC cue code data stream 216 may be further encoded by BCC encoder 202 and correspondingly decoded by BCC decoder 204, for example, based on some appropriate compression scheme (e.g., ADPCM) to further reduce the size of the transmitted data.

The definition of transmission of data from BCC encoder 202 to BCC decoder 204 will depend on the particular application of audio processing system 200. For example, in some applications, such as live broadcasts of music concerts, transmission may involve real-time transmission of the data for immediate playback at a remote location. In other applications, "transmission" may involve storage of the data onto CDs or other suitable storage media for subsequent (i.e., non-real-time) playback. Of course, other applications may also be possible.

Depending on the particular implementation, the transmission channels may be wired or wire-less and can use customized or standardized protocols (e.g., IP). Media like CD, DVD, digital tape recorders, and solid-state memories can be used for storage. In addition, transmission and/or storage may, but need not, include channel coding. Similarly, although the present invention has been described in the context of digital audio systems, those skilled in the art will understand that the present invention can also be implemented in the context of analog audio systems, such as AM radio, FM radio, and the audio portion of analog television broadcasting, each of which supports the inclusion of an additional in-band low-bitrate transmission channel.

The present invention can be implemented for many different applications, such as music reproduction, broadcasting, and telephony. For example, the present invention can be implemented for digital radio/TV/internet (e.g., Webcast) broadcasting such as Sirius Satellite Radio or XM. Other applications include voice over IP, PSTN or other voice networks, analog radio broadcasting, and Internet radio.

Depending on the particular application, different techniques can be employed to embed the sets of BCC codes into a combined channel to achieve a BCC signal of the present invention. The availability of any particular technique may depend, at least in part, on the particular transmission/storage medium(s) used for the BCC signal. For example, the protocols for digital radio broadcasting usually support inclusion of additional enhancement bits (e.g., in the header portion of data packets) that are ignored by conventional receivers. These additional bits can be used to represent the sets of auditory scene parameters to provide a BCC signal. In general, the present invention can be implemented using any suitable technique for watermarking of audio signals in which data corresponding to the sets of auditory scene parameters are embedded into the audio signal to form a BCC signal. For example, these techniques can involve data hiding under perceptual masking curves or data hiding in pseudo-random noise. The pseudo-random noise can be perceived as comfort noise. Data embedding can also be implemented using methods similar to bit robbing used in TDM (time division multiplexing) transmission for in-band signaling. Another possible technique is mu-law LSB bit flipping, where the least significant bits are used to transmit data.

The present invention may be implemented as circuit-based processes, including possible implementation on a single integrated circuit. As would be apparent to one skilled in the art, various functions of circuit elements may also be implemented as processing steps in a software program. Such software may be employed in, for example, a digital signal processor, micro-controller, or general-purpose computer.

The present invention can be embodied in the form of methods and apparatuses for practicing those methods. The present invention can also be embodied in the form of program code embodied in tangible media, such as floppy diskettes, CD-ROMs, hard drives, or any other machine-readable storage medium, wherein, when the program code is loaded into and executed by a machine, such as a computer, the machine becomes an apparatus for practicing the invention. The present invention can also be embodied in the form of program code, for example, whether stored in a storage medium or loaded into and/or executed by a machine, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. A machine-implemented method for encoding a multi-channel audio signal having a plurality of audio input channels comprising a plurality of regular channels and at least one low-frequency channel, the machine-implemented method comprising:

the machine applying a parametric audio encoding technique to generate parametric audio codes for all of the audio input channels for a first frequency region corresponding to one or more sub-bands below a specified cut-off frequency; and the machine applying the parametric audio encoding technique to generate parametric audio codes for only the regular channels for a second frequency region corresponding to one or more sub-bands above the specified cut-off frequency, wherein:

the parametric audio encoding technique generates the parametric audio codes based on inter-channel differences;

for the first frequency region, the parametric audio encoding technique generates inter-channel difference information corresponding to all of the audio input channels; and for the second frequency region, the parametric audio encoding technique generates inter-channel difference information corresponding to only the regular channels and not with respect to the at least one low-frequency channel.

2. The invention of claim 1, wherein the parametric audio encoding technique is binaural cue coding (BCC) encoding.

3. The invention of claim 1, wherein the multi-channel audio signal is a surround sound signal having the plurality of regular channels and the at least one low-frequency (LFE) channel.

4. The invention of claim 3, wherein the parametric audio encoding technique is BCC encoding.

5. The invention of claim 3, wherein the cut-off frequency is at least the effective audio bandwidth of the LFE channel.

6. The invention of claim 3, wherein the multi-channel audio signal is a 5.1 surround sound signal.

7. The invention of claim 1, further comprising transmitting the parametric audio codes for the first and second frequency regions.

8. An apparatus for encoding a multi-channel audio signal having a plurality of audio input channels comprising a plurality of regular channels and at least one low-frequency channel, the apparatus comprising:

means for applying a parametric audio encoding technique to generate parametric audio codes for all of the audio input channels for a first frequency region corresponding to one or more sub-bands below a specified cut-off frequency; and means for applying the parametric audio encoding technique to generate parametric audio codes for only the regular channels for a second frequency region corresponding to one or more sub-bands above the specified cut-off frequency, wherein:

the parametric audio encoding technique generates the parametric audio codes based on inter-channel differences;

for the first frequency region, the parametric audio encoding technique generates inter-channel difference information corresponding to all of the audio input channels; and for the second frequency region, the parametric audio encoding technique generates inter-channel difference information corresponding to only the regular channels and not with respect to the at least one low-frequency channel.

9. A parametric audio encoder, comprising:

a downmixer adapted to generate one or more combined channels from a plurality of audio input channels of a multi-channel audio signal comprising a plurality of regular channels and at least one low-frequency channel; and an analyzer adapted to generate:

(1) parametric audio codes for all of the audio input channels in a first frequency region corresponding to one or more sub-bands below a specified cut-off frequency; and (2) parametric audio codes for only the regular channels in a second frequency region corresponding to one or more sub-bands above the specified cut-off frequency, wherein:

the analyzer generates the parametric audio codes based on inter-channel differences;

for the first frequency region, the analyzer generates inter-channel difference information corresponding to all of the audio input channels; and for the second frequency region, the analyzer generates inter-channel difference information corresponding to only the regular channels and not with respect to the at least one low-frequency channel.

10. The invention of claim 9, wherein the parametric audio codes are BCC codes.

11. The invention of claim 9, wherein the multi-channel audio signal is a surround sound signal having the plurality of regular channels and the at least one low-frequency (LFE) channel.

12. The invention of claim 9, further the parametric audio encoder is adapted to transmit the parametric audio codes for the first and second frequency regions.

13. A machine-implemented method for synthesizing a multi-channel audio signal having a plurality of audio output channels comprising a plurality of regular channels and at least one low-frequency channel, the machine-implemented method comprising:

the machine applying a parametric audio decoding technique to generate all of the audio output channels for a first frequency region corresponding to one or more sub-bands below a specified cut-off frequency; and the machine applying the parametric audio decoding technique to generate only the regular channels for a second frequency region corresponding to one or more sub-bands above the specified cut-off frequency, wherein:

the parametric audio decoding technique generates audio output channels using parametric audio codes based on inter-channel differences;

for the first frequency region, the parametric audio codes correspond to inter-channel difference information corresponding to all of the audio output channels; and for the second frequency region, the parametric audio codes correspond to inter-channel difference information corresponding to only the regular channels and not with respect to the at least one low-frequency channel.

14. The invention of claim 13, wherein the parametric audio decoding technique is BCC decoding.

15. The invention of claim 13, wherein the multi-channel audio signal is a surround sound signal having the plurality of regular channels and the at least one low-frequency (LFE) channel.

16. The invention of claim 15, wherein the parametric audio decoding technique is BCC decoding.

17. The invention of claim 15, wherein the cut-off frequency is at least the effective audio bandwidth of the LFE channel.

18. The invention of claim 15, wherein the multi-channel audio signal is a 5.1 surround sound signal.

19. An apparatus for synthesizing a multi-channel audio signal having a plurality of audio output channels comprising a plurality of regular channels and at least one low-frequency channel, the apparatus comprising:

means for applying a parametric audio decoding technique to generate all of the audio output channels for a first frequency region corresponding to one or more sub-bands below a specified cut-off frequency; and means for applying the parametric audio decoding technique to generate only the regular channels for a second frequency region corresponding to one or more sub-bands above the specified cut-off frequency, wherein:

the parametric audio decoding technique generates audio output channels using parametric audio codes based on inter-channel differences;

for the first frequency region, the parametric audio codes correspond to inter-channel difference information corresponding to all of the audio output channels; and for the second frequency region, the parametric audio codes correspond to inter-channel difference information corresponding to only the regular channels and not with respect to the at least one low-frequency channel.

20. A parametric audio decoder for synthesizing a multi-channel audio signal having a plurality of audio output channels comprising a plurality of regular channels and at least one low-frequency channel, the parametric audio decoder adapted to:

apply a parametric audio decoding technique to generate all of the audio output channels for a first frequency region corresponding to one or more sub-bands below a specified cut-off frequency; and apply the parametric audio decoding technique to generate only the regular channels for a second frequency region corresponding to one or more sub-bands above the specified cut-off frequency, wherein:

the parametric audio decoder generates audio output channels using parametric audio codes based on inter-channel differences;

for the first frequency region, the parametric audio codes correspond to inter-channel difference information corresponding to all of the audio output channels; and for the second frequency region, the parametric audio codes correspond to inter-channel difference information corresponding to only the regular channels and not with respect to the at least one low-frequency channel.

21. The invention of claim 20, wherein the multi-channel audio signal is a surround sound signal having the plurality of regular channels and the at least one low-frequency (LFE) channel.

22. The invention of claim 20, wherein the parametric codes are BCC codes.

23. A computer-readable medium, having encoded thereon program code, wherein, when the program code is executed by a computer, the computer implements a method for encoding a multi-channel audio signal having a plurality of audio input channels comprising a plurality of regular channels and at least one low-frequency channel, the method comprising:

applying a parametric audio encoding technique to generate parametric audio codes for all of the audio input channels for a first frequency region corresponding to one or more sub-bands below a specified cut-off frequency; and applying the parametric audio encoding technique to generate parametric audio codes for only the regular channels for a second frequency region corresponding to one or more sub-bands above the specified cut-off frequency, wherein:

the parametric audio encoding technique generates the parametric audio codes based on inter-channel differences;

for the first frequency region, the parametric audio encoding technique generates inter-channel difference information corresponding to all of the audio input channels; and for the second frequency region, the parametric audio encoding technique generates inter-channel difference information corresponding to only the regular channels and not with respect to the at least one low-frequency channel.

24. A computer-readable medium, having encoded thereon program code, wherein, when the program code is executed by a computer, the computer implements a method for synthesizing a multi-channel audio signal having a plurality of audio output channels comprising a plurality of regular channels and at least one low-frequency channel, the method comprising:

applying a parametric audio decoding technique to generate all of the audio output channels for a first frequency region corresponding to one or more sub-bands below a specified cut-off frequency; and applying the parametric audio decoding technique to generate only the regular channels for a second frequency region corresponding to one or more sub-bands above the specified cut-off frequency, wherein:

the parametric audio decoding technique generates audio output channels using parametric audio codes based on inter-channel differences;

for the first frequency region, the parametric audio codes correspond to inter-channel difference information corresponding to all of the audio output channels; and for the second frequency region, the parametric audio codes correspond to inter-channel difference information corresponding to only the regular channels and not with respect to the at least one low-frequency channel.

25. The invention of claim 1, wherein:

for the first frequency range, the machine encodes all of the audio input channels; and for the second frequency range, the machine encodes only the regular channels and not the at least one low-frequency channel.

26. The invention of claim 13, wherein:

for the first frequency range, the machine generates all of the audio output channels; and for the second frequency range, the machine generates only the regular channels and not the at least one low-frequency channel.

* * * * *